United States Patent [19]

Kobayashi et al.

[11] Patent Number: 4,961,409

[45] Date of Patent: Oct. 9, 1990

[54] CONTROL APPARATUS FOR AN ENGINE

[75] Inventors: Kazuyuki Kobayashi; Shunichi Hayashi, both of Nagoya, Japan

[73] Assignee: Mitsubishi Jukogyo Kabushiki Kaisha, Tokyo, Japan

[21] Appl. No.: 363,199

[22] Filed: Jun. 8, 1989

[30] Foreign Application Priority Data

Jun. 29, 1988 [JP] Japan ..... 63-159441
Jun. 29, 1988 [JP] Japan ..... 63-85041[U]

[51] Int. Cl.[5] ..... F02D 11/02; F02M 1/10
[52] U.S. Cl. ..... 123/376; 261/52
[58] Field of Search ..... 123/376, 392; 261/52

[56] References Cited

U.S. PATENT DOCUMENTS 2,837,070 6/1958 Agar ..... 123/376 X
2,873,731 2/1959 Richardson ..... 261/52 X
3,326,196 6/1967 Kaufman ..... 123/392
3,886,917 6/1975 Nakada et al. .

FOREIGN PATENT DOCUMENTS 0275082 12/1988 European Pat. Off. .
61-25958 2/1986 Japan .
61-207866 9/1986 Japan .
61-241450 10/1986 Japan .

*Primary Examiner*—Tony M. Argenbright
*Attorney, Agent, or Firm*—Wenderoth, Lind & Ponack

[57] ABSTRACT

An improved control apparatus includes an auto-choke for an engine provided by interlocking a choke lever and a throttle lever of a carburetor by way of a temperature-sensitive interlocking rod. The choke lever of the carburetor is provided with a spring for resiliently biasing the choke valve toward its open position. The interlocking rod is made of high molecular material such as high molecular urethane elastomer or the like and has a buckling threshold which varies in dependence upon the temperature. Upon fully opening the throttle valve when the engine is cold, the interlocking rod acts so as to close the choke. Whereas, when the throttle valve is opened when the engine is hot the interlocking rod acts to open the choke under the biasing force of the spring. A speed regulating device is connected to the throttle lever.

12 Claims, 11 Drawing Sheets

CONTROL APPARATUS FOR AN ENGINE

BACKGROUND OF THE INVENTION

1. Field of the Invention

The present invention relates to a control apparatus for a general purpose engine usable in a working machine such as a lawn mower or the like.

2. Description of the Prior Art

First, one example of a prior art automatic choke (auto-choke) device for a small-sized general-purpose internal combustion engine will be described with reference to FIG. 7. The auto-choke device is provided with a carburetor, in which during normal operation, a choke valve 1 is opened as shown by chain lines. In this condition, a negative pressure is generated by descending movement of a piston (not shown) such that air is sucked through an air cleaner (not shown) and a choke bore 2. piston also causes fuel to be sucked and injected through a main nozzle 4. At the same time as the fuel is being injected, the air is being choked by a venturi 3. A fuel-air gas mixture is thus formed and fed into a cylinder (not shown) for combustion therein at a flow rate controlled by a throttle valve 5.

In this carburetor, when the engine is at a low temperature, the fuel fed through the main nozzle 4 often cannot fully vaporize (evaporate), such that the above-mentioned fuel-air gas mixture fed into the cylinder contains surplus air and the gas mixture falls outside of a combustible range. Thus, when the engine is at a low temperature, the choke valve 1 is used to suppress the amount of air so as to avoid the above-mentioned air surplus. It is necessary to change the opening angle of the choke valve 1 depending upon the engine temperature so as to provide the proper gas mixture. For this purpose, a bimetallic element 7 is coupled to the choke valve 1 via a choke rod 6 and the bimetallic element 7 is associated with a heater 8. The bimetallic element 7 serves as a temperature sensor for sensing the temperature of the engine due to the thermal displacement thereof upon change in temperature. The displacement of the bimetallic element 7 is transmitted through the choke rod 6 to the choke valve 1 to change the opening angle thereof. An auto-choke device is thus provided in which a thermal displacement of the bimetallic element 7 is amplified by the heater 8 which is prevented from overheating by means of a current feed control device 9.

Lawn mowers are generally provided with vertical shaft type engines mounted thereon, and are often provided with a single operation lever 21 for control of the engine E. The control provided thereby generally includes the functions of stopping, speed control and choking, as shown in FIGS. 8 and 9.

With reference to FIGS. 8–11, an example of a prior art engine E mounted on a working machine H (e.g. a lawn mower) will now be described. The engine E is mounted on the working machine H as shown in FIGS. 8 and 9, and is provided with a control apparatus for operating a throttle valve and a choke valve (not shown) of a carburetor 23 (FIG. 11) via a Bowden wire 11 by means of an operation lever 21. In FIGS. 8(A) and 8(B) reference numeral 22 designates a spark plug of an engine.

As shown in FIGS. 10 and 11, one example of a prior art control apparatus includes a clamp 12, mounted at one end portion of a control panel 10, for fixedly securing an outer cable 11*a* of a Bowden wire 11 which is connected to the operation lever 21. The control apparatus further includes a control lever 13 which is rotatably secured to the control panel 10 via a pivot 14 and to which a tip end portion of the Bowden wire 11 is connected, a stop switch terminal 15 disposed on the control panel 10 and adapted to be contacted by the control lever 13, a choke control plate 17 pivotably supported via the pivot 14 and adapted to be moved together with the control lever 13, a rotation adjusting screw 16 mounted on the control lever 13 and adapted to adjustably contact the choke control plate 17, a choke rod 18 connected at one end to a free end portion of the choke control plate 17 and at the other end to a choke lever (not shown in FIGS. 11 and 12) for actuating a choke valve (also not shown), and a governor spring 19 connected between the control lever 13 and a governor lever 24 (FIG. 11). Furthermore, as shown in FIG. 11, the governor lever 24 is fixedly secured to a governor arm 26 mounted in a cylinder block E1 of an engine by means of nuts and the like, and is thereby coupled to a throttle lever via a governor rod 25.

The operation of the above-described control apparatus will now be described. When the Bowden wire 11 is pulled in by the operation lever 21 (FIGS. 8 and 9) so as to rotate the control lever 13 as far as it will rotate in the clockwise direction as viewed in FIG. 10, the control lever 13 comes into contact with the stop switch terminal 15. Such contact with the stop switch terminal 15 results in the engine E being stopped. When the Bowden wire is pushed out so as to rotate the control lever 13 in the counterclockwise direction as viewed in FIG. 10, the governor spring 19 is stretched and the opening angle of the throttle valve in the carburetor 23 is adjusted via the governor lever 24, the governor rod 25 and the throttle lever. During initial and intermediate rotation of the control lever 13 in the counterclockwise direction as viewed in FIG. 10, the control apparatus acts as an engine speed regulating device, but when the control lever 13 is rotated in the counterclockwise direction to an extent where the adjusting screw 16 contacts the choke control plate 17, further rotation causes the choke control plate 17 to also be rotated in the counterclockwise direction as viewed in FIG. 10, such that the choke rod 18 and thus the choke lever in the carburetor 23 are caused to move, thereby causing the choke valve to close and this control apparatus to act as a choke device.

Depending upon various control factors, the clamp 12 may be mounted in alternative locations on the control panel 10 as shown by chain lines at 12'. In this situation, rather than the engine speed being increased by pushing out the Bowden wire 11 with the aid of the operation lever 21 as described above, the engine speed will be decreased by pushing out the Bowden wire.

When choking of the engine E is to be carried out by pushing out the Bowden wire 11 with the aid of the operation lever 21, it is necessary, in order to limit the length of the Bowden wire 11, to limit the mounting orientation of the engine to the two alternatives shown respectively in FIGS. 8(A) and 8(B), due to the fact that the stop switch terminal 15 is mounted in the same direction as the ignition plug 22 of the engine E.

While the above-mentioned prior art control apparatus which employs a bimetallic element (see FIG. 7) forms an automated mechanism which is responsive to engine temperature, displacement of the bimetallic element due to the engine temperature is small. Thus, it is necessary to use a heater to amplify the temperature and an electric current control device to control the heater. This requires the entire apparatus to be relatively large and expensive.

The prior art control apparatus shown in FIGS. 8 to 11 provides choking and speed regulating functions in addition to an engine stopping function. As a result, its structure is extremely complicated, requires considerable time to disassemble, assemble and adjust, and thus, suffers from low operational reliability. Also, since the choking mechanism is actuated via an operation lever, the operator must determine whether the choke should be closed or opened depending on the temperature of the engine based on his experience and a sixth sense. Such reliance on the operator's judgement inevitably results in the inconvenience of having the engine fail to start because the choke is closed when the engine is hot and of needing to repeat the starting operation a large number of times because the choke is open when the engine is cold.

In addition, the necessity of routing the Bowden wire along the shortest route, restricts the orientations in which the engine can be mounted to a working machine. Thus, if a different engine mounting orientation become necessary for maintenance and handling purposes, it has been necessary to prepare a new control apparatus, thereby resulting in low manufacturing economy of an engine.

SUMMARY OF THE INVENTION

It is therefore one object of the present invention to provide a novel control apparatus for an engine, in order to enhance choking performance and operational reliability as well as to provide a simplified speed regulating device.

Another object of the present invention is to provide an improved engine control apparatus, with which the wiring route for a Bowden wire can be shortened and which allows an engine to be mounted in different orientations.

According to one feature of the present invention, an engine control apparatus is provided, in which a choke lever of a carburetor is provided with a spring for resiliently biasing a choke valve in the opening direction, and in which the choke lever and a throttle lever are connected with each other via a choke interlocking rod which is made of high molecular material such as high molecular urethane elastomer or the like and whose buckling force varies depending upon the engine temperature. The relationships of the spring and the interlocking rod with the choke and throttle levers are such that when the engine is cold and the throttle valve is fully open, the choke valve is caused to close, while when the engine is hot and the throttle valve is opened, the choke valve remains open. Furthermore, a speed regulating device is connected to the throttle lever.

According to another feature of the present invention, the speed regulating device includes a control lever having a pair of contact portions for contacting a stop switch terminal, a pair of contact portions for contacting a rotation adjustment screw and a pair of engaging portions for engaging a governor spring. Each of the aforementioned pairs are symmetrically arranged about a center pivot of the control lever. The control lever is also provided with an engaging portion for engaging a Bowden wire connected to an operation lever. The control lever is pivotably secured to a control panel by way of the center pivot and is biased by the governor spring toward a position in which one of the contact portions contacts the stop switch terminal. A plurality of clamp mounting portions for clamping a Bowden wire are provided on a cover of the control lever. In other words, according to the last-mentioned feature of the present invention, an auto-choke device is connected to the choke lever and the throttle lever of a carburetor so as to automatically actuate the choke valve only when the engine is cold. Additionally, the mounting arrangement of the control lever of the speed regulating device can be changed by changing the position of the clamp for clamping the Bowden wire to the cover, such that the wiring route of the Bowden wire can be made as short as possible for different mounting orientations of the engine.

According to the present invention, the choke lever is resiliently biased by a spring so as to bias the choke toward its open position, a choke interlocking rod is connected between the choke lever and the throttle lever and is made of high molecular material such as high molecular urethane elastomer or the like such that its buckling force varies depending upon the engine temperature. Due to the above-mentioned relationship between the resilient biasing action of the spring and the choke interlocking rod, when the engine is cold and the throttle valve is opened the choke interlocking rod acts to close the choke valve, while when the engine is hot and the throttle valve is opened, the choke interlocking rod acts to open the choke valve. In this manner, the action of the choke valve is automated in a manner in which its operation is interlocked with the operation of the throttle valve which is actuated by a speed regulating device. Thus, improper operation of the choke valve is eliminated and the operational reliability is improved.

In addition, due to the manner in which the auto-choke device is connected between the throttle valve and choke valve of the carburetor as described above, the speed regulating device can be simplified. Also, by changing the position of the control lever, and by changing the clamp for clamping the Bowden wire between a plurality of clamp mounts provided on the cover of the control lever, the wiring route of the Bowden wire can be made as short as possible for various mounting orientations of the engine on the working machine.

The above-mentioned and other objects, features and advantages of the present invention will become more apparent by reference to the following description of one preferred embodiment of the present invention in conjunction with the accompanying drawings.

DETAILED DESCRIPTION OF THE INVENTION

Figure 1A:
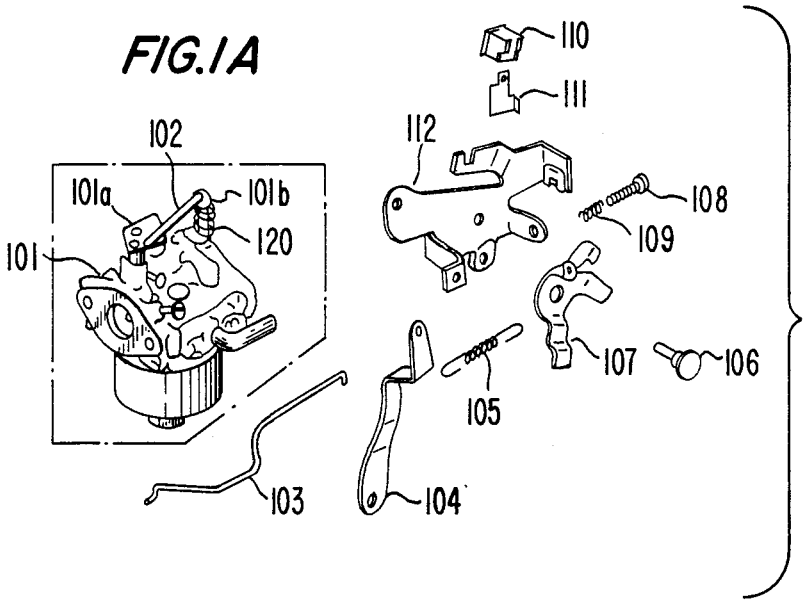
FIG. 1(A) is an exploded perspective view showing one preferred embodiment of the present invention.
Figure 1B:
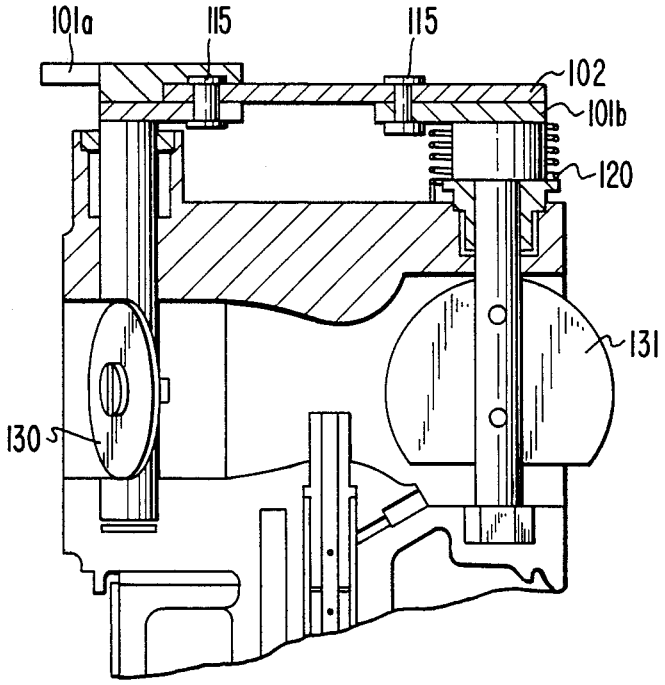
FIG. 1(B) is a longitudinal cross-section view of a carburetor of the present invention.

The present invention will now be described in greater detail in connection with a preferred embodiment illustrated in FIGS. 1 to 6. In these figures, reference numeral 101 designates a carburetor, reference numeral 101*a* designates a throttle lever for rotating a throttle valve 130 to adjust the degree of opening thereof, numeral 101*b* designates a choke lever for opening and closing a choke valve 131, and numeral 102 designates a choke interlocking rod (or member) made of high molecular material such as high molecular urethane elastomer or the like. As shown in FIGS. 1(A) and 1(B), the above-mentioned choke interlocking rod 102 is rotatably connected at one end to the choke lever 101*b* and at the other end to the throttle lever 101*a* by means of caulking pins 115. A return spring 120 is interposed and set between a body of the carburetor 101 and the choke lever 101*b*. The return spring 120 resiliently biases the choke valve 131 via the choke lever 101*b* towards its open position. The choke interlocking rod 102 made of high molecular material such as high molecular urethane elastomer or the like has a buckling threshold which varies with the engine temperature. The temperature dependent buckling threshold of the choke interlocking rod 102 is such that upon full opening of the throttle valve 130 at the time of cold starting of an engine E, the choke interlocking rod 102 is rigid and maintains the choke lever in a position which maintains the choke in a closed position, but upon full opening of the throttle E, the choke interlocking rod buckles under the return force of spring 120, such that the choke lever 101*b* is moved to a position in which it maintains the choke open. An auto-choke device is thus provided.

A speed regulating device is also provided and is connected to the throttle lever 101*a*. As illustrated in FIG. 1, reference numeral 103 designates a governor rod which is connected between the throttle lever 101*a* and a governor lever 104, numeral 105 designates a governor spring connected between the governor lever 104 and a control lever 107, the control lever 107 is pivotably mounted to a control panel 112 by means of a caulking pin 106, a rotation adjusting screw 108 is mounted to the control panel 112 along its periphery, a positioning spring 109 is disposed on the adjusting screw 108 and is interposed between the adjusting screw 108 and the control panel 112 (see FIG. 3A), and a stop switch terminal 111 is received tightly in a mounting terminal 110 (made of an insulating material such as nylon or the like mounted along the periphery of the control panel 112 outwardly of the control lever 107. One end of the stop switch terminal 111 is connected to a grounded wire so as to provide grounding for a primary current of an engine ignition device.

Figure 3A:
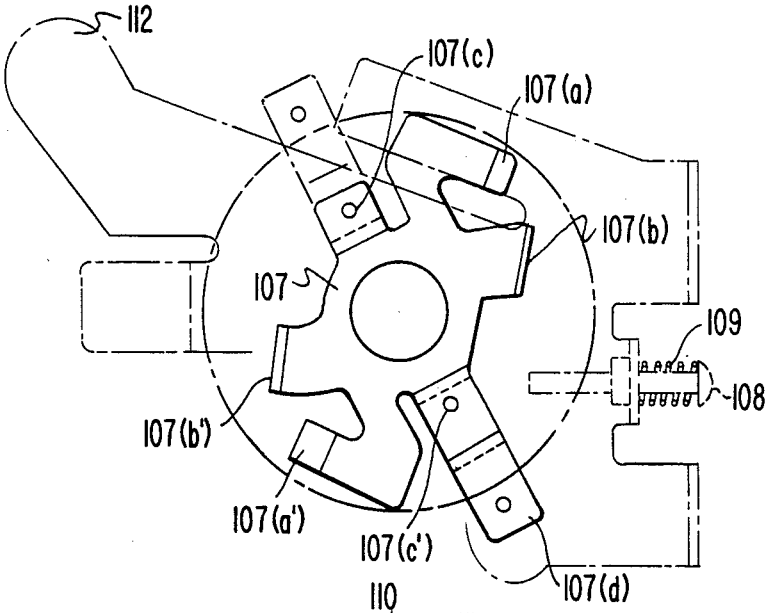
FIG. 3(A) is an enlarged front view of a control lever.
Figure 3B:
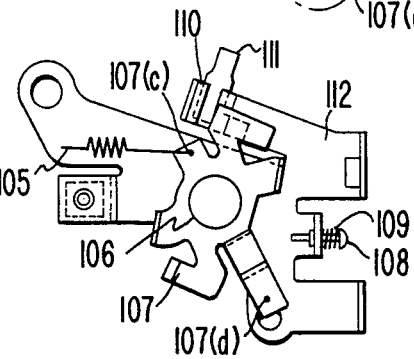
FIG. 3(B) is a front view showing a relative arrangement of a control panel and a control lever.
Figure 3C:
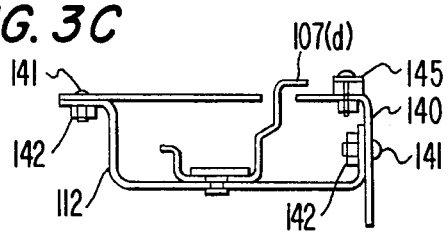
FIG. 3(C) is a longitudinal cross-section view of a control panel, a control lever and a cover.
Figure 4:
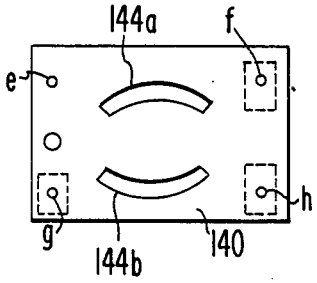
FIG. 4 is a plan view of a cover.
Figure 7:
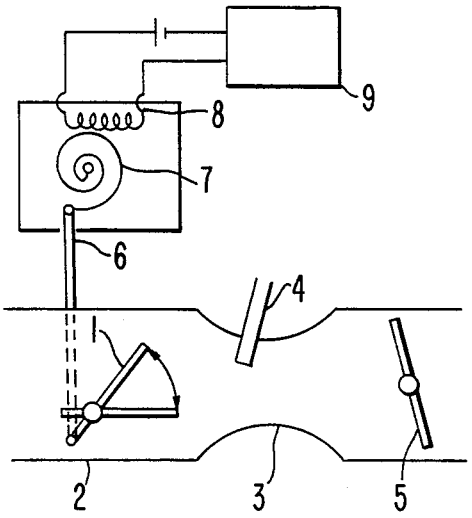
FIG. 7 (PRIOR ART)
FIG. 7 is a schematic view of a prior art auto-choke.
Figure 5:
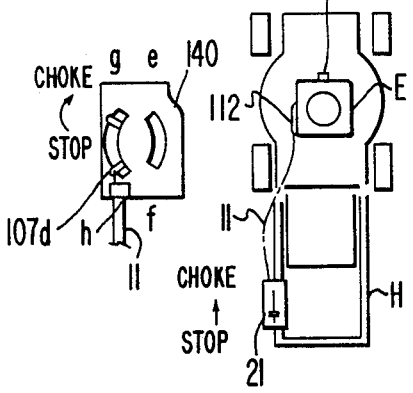
FIGS. 5(A) through 5(D) are plan views showing different mounting orientations of an engine.
Figure 5:
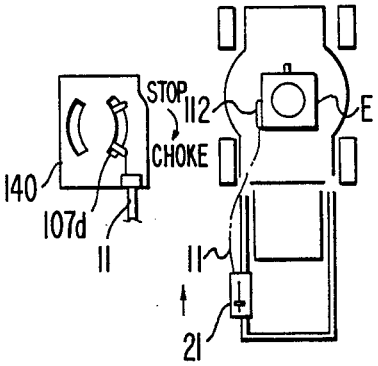
Figure 5:
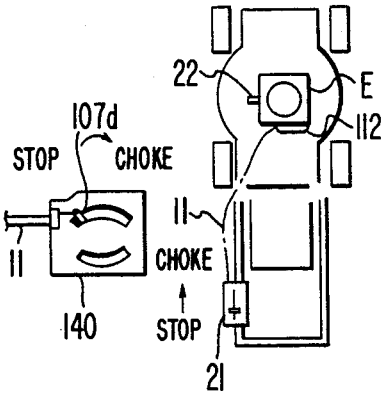
Figure 5:
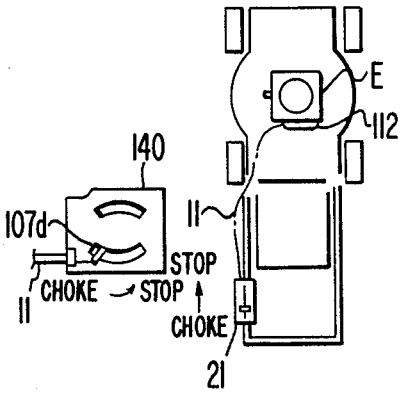

As shown in FIGS. 3 and 4, the above-described control lever 107 is provided with an outwardly projecting engaging portion 107*d* which is adapted for connection with one end of Bowden wire 11 (see FIG. 5). The other end of the Bowden wire 11 is connected to an operation lever 21 disposed on a working machine. The control lever 107 is also provided with contact portions 107*a*, 107*a'* for contacting the stop switch terminal 111, engaging portions 107*c*, 107*c'* for engaging one end of the governor spring 105 and contact portions 107, 107*b'* for contacting the rotation adjusting screw 108. Each of the above-mentioned pairs of elements 107*a* and 107*a'*, 107*b* and 107*b'*, and 107*c* and 107*c'* is respectively disposed symmetrically about caulking pin 106.

Figure 10:
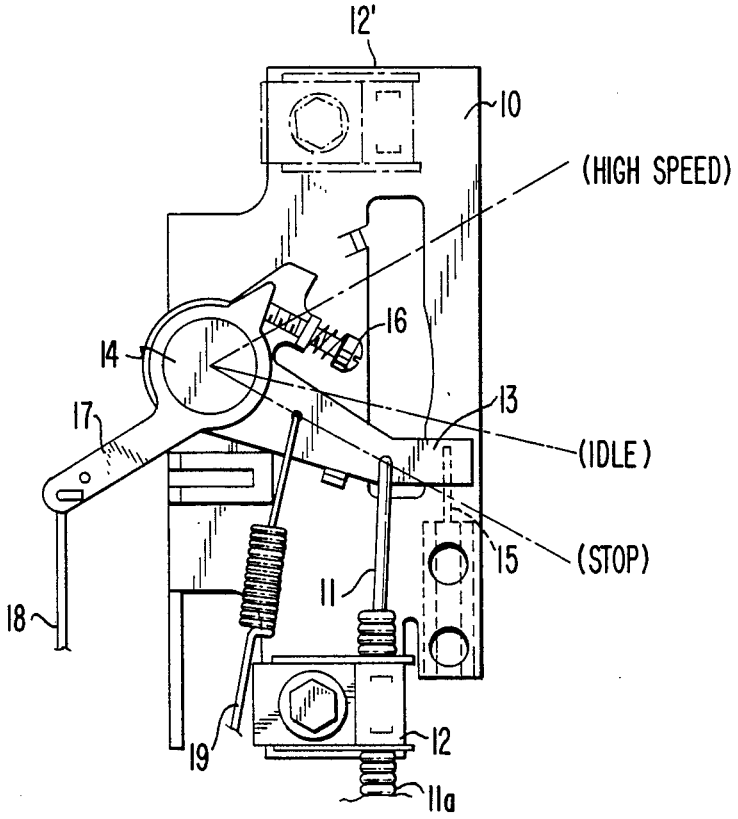
FIG. 10 (PRIOR ART)
FIG. 10 is a plan view of a portion of a prior art control apparatus for an engine.
Figure 11:
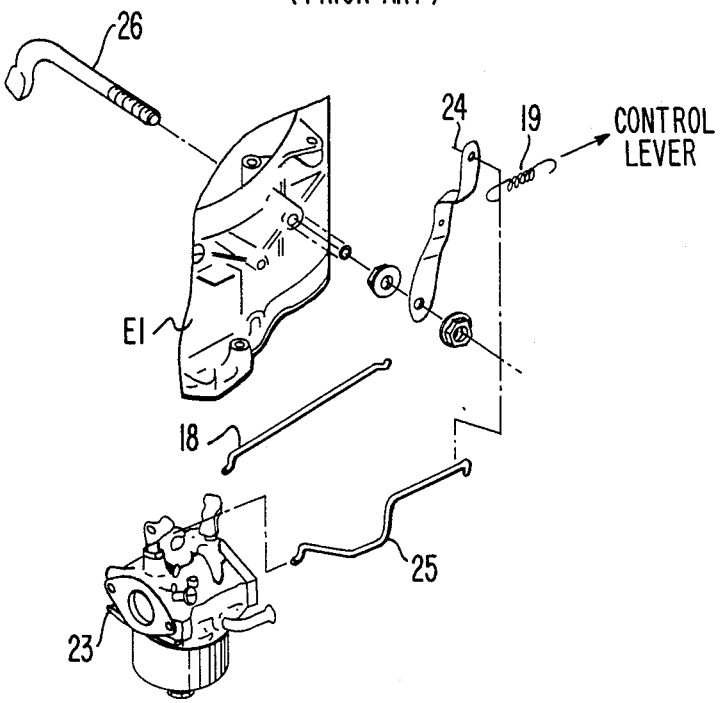
FIG. 11 (PRIOR ART)
FIG. 11 is an exploded perspective view of a prior art interlocking mechanism between a control apparatus and a carburetor.

A cover 140 for the control lever 107 is mounted to the control panel 112 by means of a bolt or machine screw 141 and a nut 142, the cover 140 is provided with elongated holes 144*a* and 144*b* for projecting the control lever 107 therethrough (FIG. 4) so that the control lever 107 can be freely rotated within a desired range by changing its disposition to a position rotated by 180° clamp mounting portions e, f, g and h are provided at the four corner portions of the cover 140 for mounting a clamp (such as shown at 12 in prior art FIG. 10) for fixedly securing the outer cable 11*a* of the Bowden wire 11 to the cover 140 at any of the four corners. The above-mentioned choke interlocking rod 102 is preferably made of a urethane elastomer produced by polymerizing isofolon-diisocyanate and bisphenol in a manner so as to set its glass transition temperative Tg (where its modulus of longitudinal elasticity changes abruptly) in the temperature range of 10°-30° C. The force necessary to buckle the choke interlocking rod 102 will change abruptly in the neighborhood of the glass transition temperature Tg.

The desired glass transition temperature Tg and the desired modulus of elasticity of the temperature sensitive urethane elastomer choke interlocking rod 102 are obtained in the following manner.

Any substance can be employed as the high molecular elastomer which forms the choke interlocking rod 102 so long as it is an elastomer having a glass transition temperature Tg in the desired range, but elastomers whose modulus of elasticity changes substantially near the glass transition temperature Tg are preferable. Normally, polyurethane elastomer, styrenebutadiene elastomer, nitrile-butadiene elastomer, etc. are to be employed.

Description will now be made of examples of manufacturing methods for obtaining polyurethane elastomers having various glass transition temperatures Tg. There is no special restrictions as to what isocyanate component can be used for manufacturing the polyurethane elastomer, so long as it is a component normally used for polyurethane. For example, diphenylmethane-diisocyanate, 2,4- or 2,6-trilene-diisocyanate, m- or p-phenylene-diisocyanate, isofolon-diisocyanate, hexamethylene-diisocyanate, and coarse components or a mixture of these isocyanates can be used.

Furthermore, a component having two or more hydroxyl radicals in one molecule can be used as a polyol component. For example, polyoxyalkylene polyol manufactured by employing polyhydric alcohol, aliphatic amine, aromatic amine or the like as an initiator and adding alkylene oxide thereto, polyester polyol manufactured by polymerization of acid and alcohol, polytetramethylene glycol or poly-butadiene polyol can be used.

Diols having a short chain such as ethylene glycol, 1,4-butadiol and the like, diamines such as ethylene diamine, propane diamine and the like, or isocyanate compounds having a relatively low molecular weight such as trilenediisocyanate addition products to trimethylolpropane, can be used as a chain extending agent.

the combination of a hard segment (isocyanate, chain extending agent) and a soft segment (polyol) of polyurethane elastomer. Likewise, with respect to styrene-butadiene elastomer and nitrile-butadiene elastomer also, a glass transition temperature Tg can be freely selected by changing the proportion of a hard segment (styrene or nitrile) and a soft segment (butadiene).

While the high molecular elastomers as described above are used as a material for a temperature-sensitive member (i.e. the choke interlocking member 102), the shape thereof is not critical.

TABLE 1

| | Prepolymer Isocyanate | Prepolymer Polyol | A = [NCO]/[OH] | Chain extending agent | B = [chain extending agent]/[prepolymer] | Tg[6] °C. |
|---|---|---|---|---|---|---|
| 1 | Isofolon Diisocyanate | BPX-55[1] | 0.62[5] | TDI addact of trimethylol propane | 6<br>18 | 31<br>107 |
| 2 | Isofolon Diisocyanate/ Diphenylmethane diisocyanate = 1/1 | F15-20[2] | 0.77 | ↑ | 6<br>12 | 6<br>15 |
| 3 | Isofolon Diisocyanate | BPE-100[3] | 0.82 | ↑ | 12<br>18 | 48<br>92 |
| 4 | Isofolon Diisocyanate/ Diphenylmethane diisocyanate = 1/1 | BPX-33[4] | 0.82 | ↑ | 12<br>18 | 68<br>~122 |

[1]Polyol manufactured by ASAHI DENKA KOGYO (K. K.)
[2]Polyol manufactured by ASAHI DENKA KOGYO (K. K.)
[3]Polyol manufactured by SANYO KASEI KOGYO (K. K.)
[4]Polyol manufactured by ASAHI DENKA KOGYO (K. K.)
[5]react in 50% solution of 4-methyl-2-penthanon
[6]Measured by DSC (mean values)

TABLE 2

| | Prepolymer Isocyanate | Prepolymer Polyol | A = [NCO]/[OH] | Chain extending agent | B = [chain extending agent]/[prepolymer] | Tg[6] °C. |
|---|---|---|---|---|---|---|
| 1 | 2,4-Trilene-Diisocyanate | P-1000[1] | 3 | 1,4-Buthane diol | 0.6 | −5 |
| 2 | ↑ | ↑ | 4 | ↑ | ↑ | 5 |
| 3 | ↑ | ↑ | 5.2 | ↑ | ↑ | 20 |

[1]Polyol manufactured by ASAHI DENKA KOGYO (K. K.)
[2]Measured by DSC (mean values)

Also, depending on the particular requirements, well-known catalysts such as third class amines, metal salt or the like are used.

Synthesis of polymethane elastomer is carried out by first making the isocyanate and the polyol react at a particular compounding ratio A=[NCO]/[OH] to synthesize in the form of a prepolymer, then adding the chain extending agent so as to attain a desired compounding ratio B=[chain extending agent]/[prepolymer], and thereafter effecting debubbling, mold injection and bridging reaction.

The following factors influence the glass transition temperature Tg and the modulus of elasticity: (1) kinds of isocyanates, (2) kinds of polyols, (3) kinds of chain extending thermal hysteresis. By appropriately combining these conditions, it is possible to synthesize polyurethane elastomer which has the desired glass transition temperature Tg and the desired modulus of elasticity.

Tables 1 and 2 indicate glass transition points Tg of various kinds of polyurethane elastomers synthesized according to the above-mentioned procedure.

As will be apparent from Table-1 and Table-2, a glass transition temperature Tg can be arbitrarily selected by Although the choke interlocking member has been referred to and shown as a rod, it can be of any configuration. For instance, it can be formed as a sheet or in a spiral spring shape. The force $P_K$ necessary to buckle the choke interlocking rod (or member) 102 is represented by the following formula:

$$P_K = \frac{\pi^2 EI}{l^2} \quad (1)$$

where E represents the modulus of longitudinal elasticity, I represents the cross-section secondary moment, and l represents the length. It is thus seen that the buckling force $P_K$ changes upon a change of the modulus of longitudinal elasticity E at the boundary of Tg. Operation of the choke will now be explained with reference to FIG. 2 which shows different relative positionings of the choke interlocking rod (or member) for different engine temperatures and operating states.

Figure 2A:
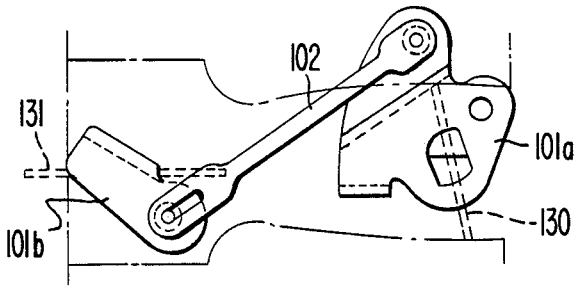
FIGS. 2(A) through 2(E) are schematic plan views showing successive steps of an operation of an auto-choke device according to the present invention.

As shown in FIG. 2A, when the engine is first stopped, the throttle valve 130 of the carburetor is in its fully closed position because the speed regulating device is in its stop position. The choke interlocking rod 102 is in a position which allows the choke lever 101*b* to be positioned so that the choke valve 131 is fully open. The choke valve 131 is further biased toward its open position by the return spring 120.

Figure 2B:
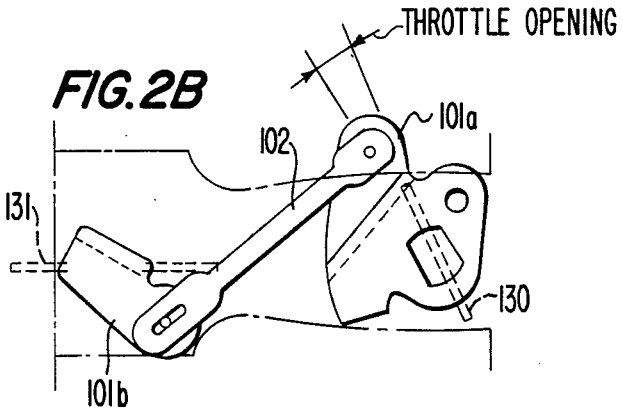
Figure 2C:
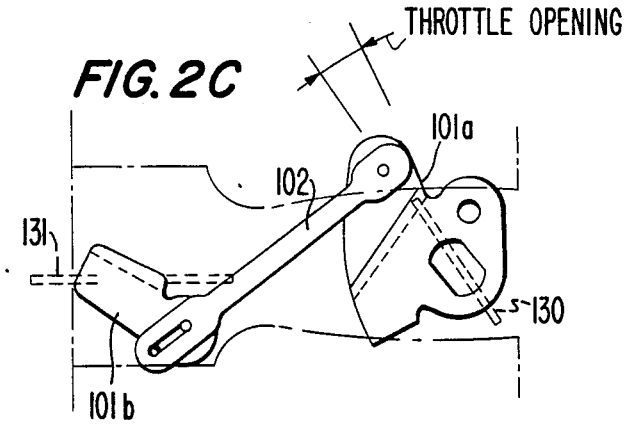
Figure 2D:
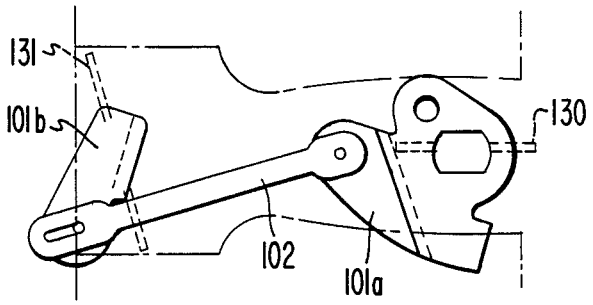

As shown in FIG. 2D, when the engine is cold (i.e. at a temperature lower than the glass transition temperature Tg of the choke interlocking rod 102) and the speed regulating device is at its starting position, the throttle valve 130 of the carburetor is held in its fully open position. Because the buckling force $P_{KS}$ exerted by the spring 120 is less than the force $P_{KC}$ necessary to buckle the choke interlocking rod 102 (i.e. $P_{KS}<P_{KC}$), the choke interlocking rod 102 is rigid and holds the choke lever 101*b* against the bias force of the return spring 120, at a position in which the choke valve 131 is fully closed.

Figure 2E:
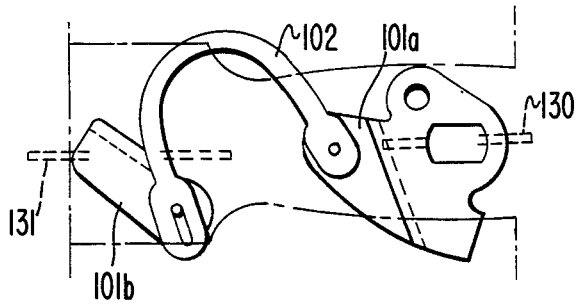

As shown in FIG. 2E, when the engine is hot (i.e. at a temperature equal to or higher than the glass transition temperature Tg of the choke interlocking rod 102) and the speed regulating device is in its starting position, the throttle valve 130 is held at its fully open position. Because of the high temperature, the buckling force $P_{KS}$ exerted by the spring 120 is larger than the force $P_{KC}$ needed to buckle the choke interlocking rod 102 (i.e. $P_{KS}>P_{KC}$). The choke interlocking rod 102 is caused to buckle and thus cannot retain the choke lever, and thus the choke valve 131, in a closed position against the bias of return spring 120. Therefore, the choke valve is held in its closed position by the force of the spring 120.

Figure 6:
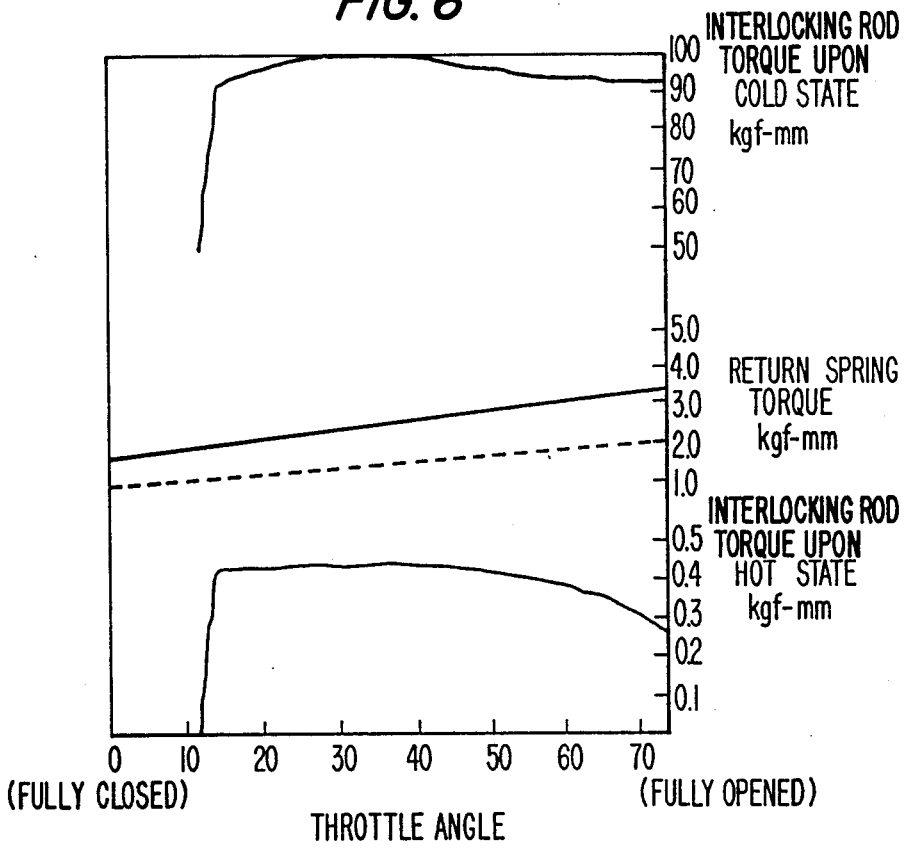
FIG. 6 is a diagram of measured data showing relations between various torques acting upon a choke shaft and a degree of opening of a throttle valve.
Figure 8A:
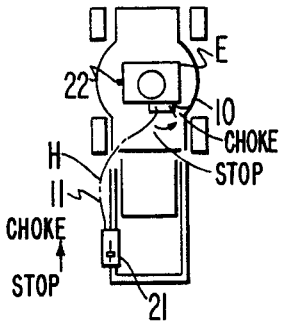
FIG. 8A (PRIOR ART)
FIGS. 8(A) and 8(B) are plan views showing two alternative arrangements for mounting an engine according to the prior art.
Figure 8B:
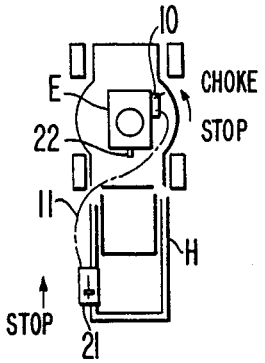
FIG. 8B (PRIOR ART)
Figure 9:
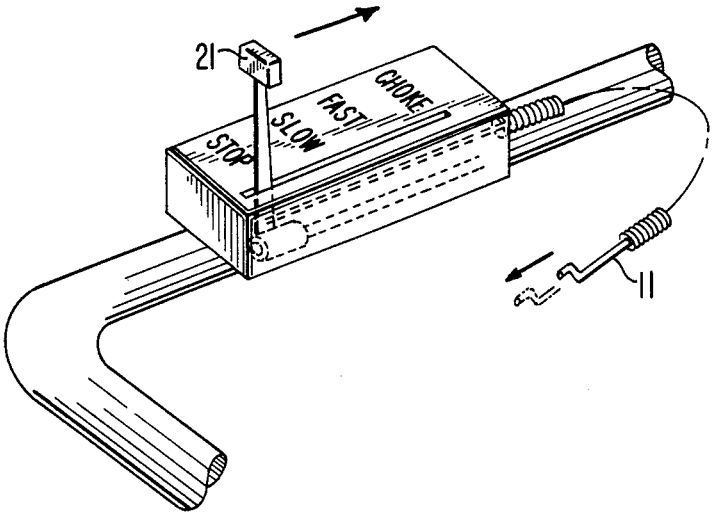
FIG. 9 (PRIOR ART)
FIG. 9 is a perspective view of a prior art operation lever.

FIG. 6 sets forth a graph which illustrates measured values of the torque which acts upon the choke valve in different temperature ranges of the interlocking rod 102 due to the forces imparted by the interlocking rod 102 and return spring 120. When the temperature of the choke interlocking rod 102 is higher than the glass transition temperature Tg, the torque exerted upon the choke valve is less than one-half of the torque exerted by the spring 120. Therefore, the return spring 120 provides the dominant force and the choke valve 131 is moved to its fully open position by the return spring 120 when the throttle valve is opened. On the other hand, when the choke interlocking rod 102 is at a temperature lower than the glass transition temperature Tg, the torque exerted upon the choke valve 131 is more than 20 times the torque exerted by the return spring 120. Therefore, the interlocking rod 120 provides the dominant force and the choke valve 131 is moved to its closed position when the throttle valve 130 is opened. The reason why the torque exerted by the choke interlocking rod 102 does not increase until the throttle opening angle is close to 12 degrees (see FIG. 6), is because the the pivot hole in rod 102 which receives the pin 115 to rotatably connect the interlocking rod 102 to the choke lever 101*b* is elongated so as to provide a lost-motion coupling. The range of lost motion can be selected by manipulating various factors such as the length of the elongated hole, the length of the rod 102, and the like. In general, the highest rotational speed of a crank shaft in a general purpose internal combustion engine which utilizes an auto-choke is about 4000 rpm, and in the prior art, the opening angle of a throttle where no load is placed on the engine is generally about 10–12 degrees at the highest rotational speed of the crank shaft. As shown in FIGS. 2(B) and 2(C), the auto-choke of the present invention is such that after starting of the engine with no loading on the engine, the choke valve 131 can be held at a fully opened state.

Furthermore, after starting of the engine, since the temperature of the choke interlocking rod eventually becomes higher than the glass transition temperature Tg, the choke valve will not close when the throttle valve 130 is fully opened so that the engine is operated properly without inconvenience.

Moreover, as shown in FIG. 2(A), when the engine is stopped, the throttle is fully closed while the choke remains open because the stop switch terminal 111 is positioned such that the ignition is deactivated when the control level 107 is positioned to fully close the throttle valve 130. Accordingly, during operation of the engine, the choke valve 130 is opened and closed automatically in dependence on the engine temperature (as it affects the temperature of the choke interlocking rod). Thus, when the engine is properly warmed up, the choke valve is automatically opened fully.

The manner in which the above-described speed regulating device is arranged can be modified by rotating control lever 107 through 180° such that the engaging portion 107*d* is positioned at the position shown by chain lines in FIG. 3(A) rather than the position shown by solid lines. This is possible because the control lever 107 can be projected through either of the elongated holes 144*a* or 144*b* in the cover 140, the governor spring 105 can be engaged with either of the engaging holes 107*c* or 107*c'*, either of the contact portions 107*a* or 107*a'* can be used to contact the stop switch terminal 111 and either of the contact portions 107*b* or 107*b'* can be used to contact the rotation adjusting screw 108.

The manner in which the speed regulating device is arranged can also be changed by clamping the outer cable of the Bowden wire 11 to different ones of the clamp mounting portions e, f, g, and h (see FIG. 4).

As shown in FIGS. 5(A) and 5(B), the engine E can be mounted to the working machine H with its spark plug 22 directed in the forward direction of the working machine. In FIG. 5(A), the speed regulating device is arranged with the engaging portion 107*b* of the control lever positioned at its lower position (as shown in solid lines in FIG. 3(A)) where the engaging portion 107*d* projects through the lower elongated hole 144*b* in the cover 140, and the outer cable of the Bowden wire 11 is clamped at the position h. This arrangement is such that the throttle valve 130 is opened and the choke valve 131 is closed by advancement of the Bowden wire 11 with the operation lever 21. In FIG. 5(B), the outer cable of the Bowden wire is clamped at the upper position f. With this arrangement, the throttle valve 130 is opened and the choke valve 131 is closed by retraction of the Bowden cable 11 with the operation lever 21.

As shown in FIGS. 5(C) and 5(D), the engine can also be mounted with its spark plug 22 directed to the left with respect to the forward direction of the working machine by properly arranging the control lever 107 and the Bowden cable 11.

After a control apparatus according to the invention has been manufactured, an engine manufacturer can mount the control apparatus onto an engine such that it results in either of the arrangements shown in FIGS. 5(B) or 5(C) by positioning the engaging portion 107*d* at its upper position and connecting the governor spring 105 to the engaging hole 107*c'*. Conversely, the control apparatus can be arranged such that it results in the arrangement of either of FIGS. 5(A) and 5(C) by positioning the engaging portion 107*d* at its lower position and connecting the governor spring 105 to the engaging hole 107c. Thus, the wiring route of the Bowden cable 11 can be easily shortened and the engine orientation can be changed by merely changing the position of the control lever 107 and the relative mounting of the Bowden cable 11 to the cover 140.

The engine control apparatus according to the present invention is constructed in the above-described manner. That is, the auto-choke device is concentrically disposed between parts of the carburetor, and is connected in a simple manner to the speed regulating device. The choking operation is automated by providing a temperature sensitive rod for interlocking the operation of the throttle lever with the operation of the choke lever, so as to enhance the choking performance and operational reliability of the engine. Furthermore, the wiring route of the Bowden wire can be shortened and the mounting orientation of the engine to the working machine can be greatly diversified, by rotating the control lever of the speed regulating device and changing the position of the clamp for clamping the Bowden wire to the cover. This provides for versatility in mounting the engine, and in mounting the Bowden cable.

While a principle of the present invention has been described above in connection to one preferred embodiment of the invention, it is a matter of course that many different embodiments of the present invention can be made without departing from the spirit of the invention.

What is claimed is:

1. A control apparatus for an engine having a carburetor with a choke valve and a throttle valve, comprising a choke lever connected to the choke valve;

a throttle lever connected to the throttle valve;

spring means for resiliently biasing the choke valve toward an open position;

interlocking means, comprising an interlocking element formed of a high molecular material having a buckling threshold which varies in dependence on the temperature of the engine, for interlocking said choke lever with said throttle lever in such a manner that upon full opening of said throttle valve when the engine is cold, said choke lever and said throttle lever are rigidly interlocked and the choke valve is closed, and upon full opening of said throttle valve when the engine is hot, said choke lever and said throttle lever are yieldably interlocked and the choke valve is opened under the bias of said spring means; and a speed regulating means, connected to said throttle lever, for opening and closing the throttle valve.

2. A control apparatus as recited in claim 1, wherein said interlocking element is formed of a high molecular urethane elastomer.

3. A control apparatus as recited in claim 1, wherein said interlocking element is a rod.

4. A control apparatus as recited in claim 1, wherein said interlocking element is pivotally connected at one end to said choke lever and pivotally mounted at the other end to said throttle lever.

5. A control apparatus as recited in claim 4, wherein said interlocking element is connected to said choke lever by a pin which is connected to one of said choke lever and said interlocking element and is slidably engaged in a slot formed in the other of said choke lever and said interlocking element.

6. A control apparatus as recited in claim 5, wherein said slot is formed in said interlocking element.

7. A control apparatus as recited in claim 1, wherein said interlocking element is connected to said choke lever by a pin which is connected to one of said choke lever and said interlocking element and is slidably engaged in a slot formed in the other of said choke lever and said interlocking element.

8. A control apparatus as recited in claim 7, wherein said slot is formed in said interlocking element.

9. A control apparatus for an engine operatively connected to an operation lever via a Bowden cable and having a carburetor with a choke valve and a throttle valve, comprising:

an automatic choke device, including a choke lever connected to the choke valve, a throttle lever connected to the throttle valve, spring means for resiliently biasing the choke valve toward an open position, and interlocking means, comprising an interlocking element formed of a high molecular material having a buckling threshold which varies in dependence on the temperature of the engine, for interlocking said choke lever and said throttle lever in such a manner that upon full opening of said throttle valve when the engine is cold, said choke lever and said throttle lever are rigidly interlocked and the choke valve is closed, and upon full opening of said throttle valve when the engine is hot, said choke lever and said throttle lever are yieldably interlocked and the choke valve is opened under the bias of said spring means; and a speed regulating device including a control panel having a portion adapted to receive a stop switch terminal, a rotation adjusting screw connected to said control panel, and a control lever, pivotably mounted to said control panel about an axis, having a first pair of contact portions symmetrically disposed on opposite sides of said axis and being adapted to contact the stop switch terminal, a second pair of contact portions symmetrically disposed on opposite sides of said axis and being adapted to contact said rotation adjusting screw, and a pair of engaging holes symmetrically formed on opposite sides of said axis and being adapted to engage one end of a governor spring.

10. A control apparatus as recited in claim 9, wherein said speed regulating device further includes a cover with a plurality of clamps thereon for selectively engaging the Bowden cable.

11. A control apparatus as recited in claim 10, wherein said cover has two slots formed therein symmetrically about said axis, and said control lever includes an engaging portion which extends through one of said two slots and is adapted to engage with the Bowden wire such that retraction and extension of the Bowden wire will cause said control lever to pivot about said axis.

12. A control apparatus as recited in claim 9, wherein said control lever includes an engaging portion which is adapted to engage with the Bowden wire such that retraction and extension of the Bowden wire cause said control lever to pivot about said axis.

* * * * *